US007095308B2

(12) United States Patent
Kobayashi

(10) Patent No.: US 7,095,308 B2
(45) Date of Patent: Aug. 22, 2006

(54) STEP-UP TRANSFORMER

(75) Inventor: Kenichi Kobayashi, Kanagawa (JP)

(73) Assignee: Sony Corporation, (JP)

( * ) Notice: Subject to any disclaimer, the term of this patent is extended or adjusted under 35 U.S.C. 154(b) by 35 days.

(21) Appl. No.: 10/513,844

(22) PCT Filed: May 30, 2003

(86) PCT No.: PCT/JP03/06812

§ 371 (c)(1),
(2), (4) Date: Nov. 5, 2004

(87) PCT Pub. No.: WO03/102980

PCT Pub. Date: Dec. 11, 2003

(65) Prior Publication Data

US 2005/0174210 A1 Aug. 11, 2005

(30) Foreign Application Priority Data

May 31, 2002 (JP) ..... 2002-159903
Apr. 28, 2003 (JP) ..... 2003-124022

(51) Int. Cl.
*H01F 27/30* (2006.01)

(52) U.S. Cl. ..... 336/206; 336/208; 336/198; 363/20

(58) Field of Classification Search ..... 336/206, 336/198; 363/20
See application file for complete search history.

(56) References Cited

U.S. PATENT DOCUMENTS 4,841,201 A * 6/1989 Takizawa et al. ..... 315/411
5,696,477 A * 12/1997 Yamamori et al. ..... 336/192
5,768,113 A * 6/1998 Safraoui ..... 363/17
5,815,061 A * 9/1998 Ho ..... 336/192
6,341,075 B1 * 1/2002 Yasumura ..... 363/21.02
6,627,660 B1 * 9/2003 Piccariello et al. ..... 514/567
6,956,749 B1 * 10/2005 Yasumura ..... 363/19

FOREIGN PATENT DOCUMENTS

JP 2001-119945 4/2001

* cited by examiner

*Primary Examiner*—Anh Mai
(74) *Attorney, Agent, or Firm*—Lerner, David, Littenberg, Krumholz & Mentlik, LLP

(57) ABSTRACT

Open ends of a number of secondary windings are fixed by winding them around a film projection portion formed by cutting and raising insulating films provided between the layers of the secondary windings. This eliminates the requirement that a number of terminals on a bobbin corresponding to the secondary windings be fixed by winding them around the film projection portion, whereby the number of terminals provided on the bobbin can be reduced, and the bobbin can be made smaller in size.

7 Claims, 13 Drawing Sheets

STEP-UP TRANSFORMER

TECHNICAL FIELD

The present invention relates to a step-up transformer which includes a plurality of secondary windings laminated in a plurality of layers with insulating films therebetween, divided on the basis of a predetermined number of turns, and opened at one-side ends thereof and which is preferable for use, for example, as a high voltage generating transformer.

BACKGROUND ART

As a step-up transformer for generating a high voltage for a cathode ray tube, there has hitherto been proposed one which includes a plurality of secondary windings, for example, eight secondary windings laminated in a plurality of layers, for example, eight layers with insulating films therebetween, divided on the basis of a predetermined number of turns, and opened at one-side ends thereof, as shown in FIG. 9.

Referring to FIG. 9, symbol 10 denotes a commercial power source of, for example, 100 V and 50 Hz. One end and the other end of the commercial power source 10 are connected respectively to one end and the other end of a rectifying circuit 11 having a diode bridge configuration, a positive output terminal of the rectifying circuit 11 is earthed through a smoothing capacitor 12, and a negative output terminal of the rectifying circuit 11 is earthed.

The positive output terminal of the rectifying circuit 11 is connected to a power source terminal of an oscillation drive circuit 14 through a resistor 13, and the positive output terminal is earthed through a switching circuit 15 consisting, for example, of a series circuit of MOS-FET switching devices Q1 and Q2. The switching circuit 15 is so driven that the switching devices Q1 and Q2 show alternative conduction at a predetermined frequency by the oscillation drive circuit 14.

Furthermore, the switching circuit 15 constitutes a half-bridge circuit, the positive output terminal of the rectifying circuit 11 is connected to the drain of the switching device Q1, and the source of the switching device Q2 is earthed. In addition, damper diodes D1 and D2 are connected in parallel to the switching devices Q1 and Q2, respectively.

A connection point between the source of the switching device Q1 and the drain of the switching device Q2 is earthed through a series circuit of a resonant capacitor 16, a coil 17, and a primary winding 18 of a step-up transformer T.

The primary winding 18 of the step-up transformer T is supplied with a current at a resonance oscillation frequency intrinsic of the series circuit.

Symbols 19*a*, 19*b* . . . 19*h* denote eight secondary windings which, as shown in FIG. 11, are laminated on a bobbin 107 with insulating films 105 therebetween, are divided on the basis of a predetermined number of turns, and are opened at one-side ends thereof. Rectifying diodes 20*a*, 20*b* . . . 20*h* are each connected, in a vertical row fashion, to a point between the other-side ends of each adjacent pair of the secondary windings, of the eight secondary windings 19*a*, 19*b* . . . 19*h*.

Specifically, the diode 20*a* is connected to a point between the other-side ends of the secondary windings 19*a* and 19*b*, the diode 20*b* is connected to a point between the other-side ends of the secondary windings 19*b* and 19*c*, the diode 20*c* is connected to a point between the other-side ends of the secondary windings 19*c* and 19*d*, the diode 20*d* is connected to a point between the other-side ends of the secondary windings 19*d* and 19*e*, the diode 20*e* is connected to a point between the other-side ends of the secondary windings 19*e* and 19*f*, the diode 20*f* is connected to a point between the other-side ends of the secondary windings 19*f* and 19*g*, the diode 20*g* is connected to a point between the other-side ends of the secondary windings 19*g* and 19*h*, and the diode 20*h* is connected to a point between the other-side end of the secondary winding 19*h* and the earth.

An equivalent circuit of the secondary winding system constituted of the eight secondary windings 19*a*, 19*b* . . . 19*h* and the eight rectifying diodes 20*a*, 20*b* . . . 20*h* is as shown in FIG. 10. By subjecting the voltages obtained at the secondary windings 19*a*, 19*b* . . . 19*h* to full-wave double-voltage rectification to produce DC voltages and laying up the DC voltages, it is possible to obtain a high DC voltage, for example, 32.4 kV. In FIG. 10, capacitors 21*a*, 21*b* . . . 21*h* are inter-layer capacitances of the secondary windings 19*a*, 19*b* . . . 19*h*.

In addition, the other-side end of the secondary winding 19*a* is connected to a high-voltage output terminal 23 through a diode 22, and a connection point between the diode 22 and the high-voltage output terminal 23 is earthed through a smoothing capacitor 24.

Besides, the high-voltage output terminal 23 is earthed through a series circuit of resistors 25 and 26, a detection voltage of a high voltage obtained at a connection point between the resistors 25 and 26 is supplied to a control circuit 27, and the oscillation frequency of the oscillation drive circuit 14 is controlled according to a DC voltage obtained at the high-voltage output terminal 23 by the control circuit 27 so that the high DC voltage obtained at the high-voltage output terminal 23 will be constant.

Meanwhile, a sectional view of an example of the entire constitution of the high voltage generating transformer as shown in FIG. 9 is as shown in FIG. 12, in which symbol 101 denotes the secondary winding system. As shown in FIGS. 11 and 13, the secondary winding system 101 has a structure in which the eight secondary windings 19*a*, 19*b* . . . 19*h* in the state of being laminated in eight layers with the insulating films 105 therebetween are wound around the outer circumferential surface of the roughly cylindrical bobbin 107 having walls along both side edges, the insulating films 105 are, for example, belt-like in shape, and the secondary windings 19*a*, 19*b* . . . 19*h* are so wound as to have a width slightly smaller than the width of the insulating films 105.

Conventionally, the one-side ends and the other-side ends of the eight secondary windings 19*a*, 19*b* . . . 19*h* have been fixed by binding them respectively onto terminals 103 and 104 provided, through terminal bases 103*a* and 104*a*, on one side and the other side of the bobbin 107, and the diodes 20 and the like have been connected to the terminals 103 and 104 to assemble a circuit as shown in FIG. 9.

In addition, as shown in FIG. 12, the secondary winding system 101 is disposed so as to penetrate through a core 142, which forms a closed magnetic circuit at the center thereof, together with the bobbin 102*a* and a primary winding system 102 constituted of the primary winding 18.

However, when the one-side ends and the other-side ends of the plurality of windings, for example, the eight windings 19*a*, 19*b* . . . 19*h* are fixed by binding them respectively onto the terminals 103 and 104 as in the related art, where the number of the secondary windings 19*a*, 19*b* . . . 19*h* connected as required is eight, for example, the numbers of the terminals 103 and 104 provided on the bobbin 107 are each eight, i.e., a total of 16 terminals are needed, as shown in FIG. 13. Thus, in the related art, the number of the terminals needed is large, and the bobbin 107 is enlarged in size accordingly.

In consideration of the foregoing, it is an object of the present invention to make it possible to reduce the number of terminals required on a bobbin and to reduce the bobbin in size.

DISCLOSURE OF INVENTION

According to the present invention, there is provided a step-up transformer including: a primary winding supplied with a switching voltage obtained through switching at a predetermined frequency; a plurality of secondary windings for stepping up the switching voltage supplied to the primary winding which are laminated in a plurality of layers, are divided on the basis of a predetermined number of turns, and are opened at one-side ends thereof; a bobbin which provides a predetermined spacing between the plurality of secondary windings and the primary winding and which includes a plurality of terminals for winding the other-side ends of the plurality of secondary windings therearound; a core inserted in the bobbin, and excited by the switching voltage supplied to the primary winding, to form a closed magnetic circuit; insulating films wound around the bobbin so as to space the plurality of secondary windings from each other by respective predetermined thicknesses; rectifying portions provided respectively at the other-side ends of the plurality of secondary windings, for rectifying stepped-up voltages obtained at the other-side ends of the secondary windings; and a film projection portion formed by cutting and raising the insulating films, for winding the one-side ends of the secondary windings therearound.

According to the present invention as above, the open one-side ends of the plurality of secondary windings are fixed by winding them around the film projection portion formed by cutting and raising the insulating films provided between the layers of the secondary windings. Therefore, the number of the terminals on the bobbin can be reduced, for example, to ½ times the original number in a conventional design, and the bobbin can be reduced in size.

BEST MODE FOR CARRYING OUT THE INVENTION

Figure 1:
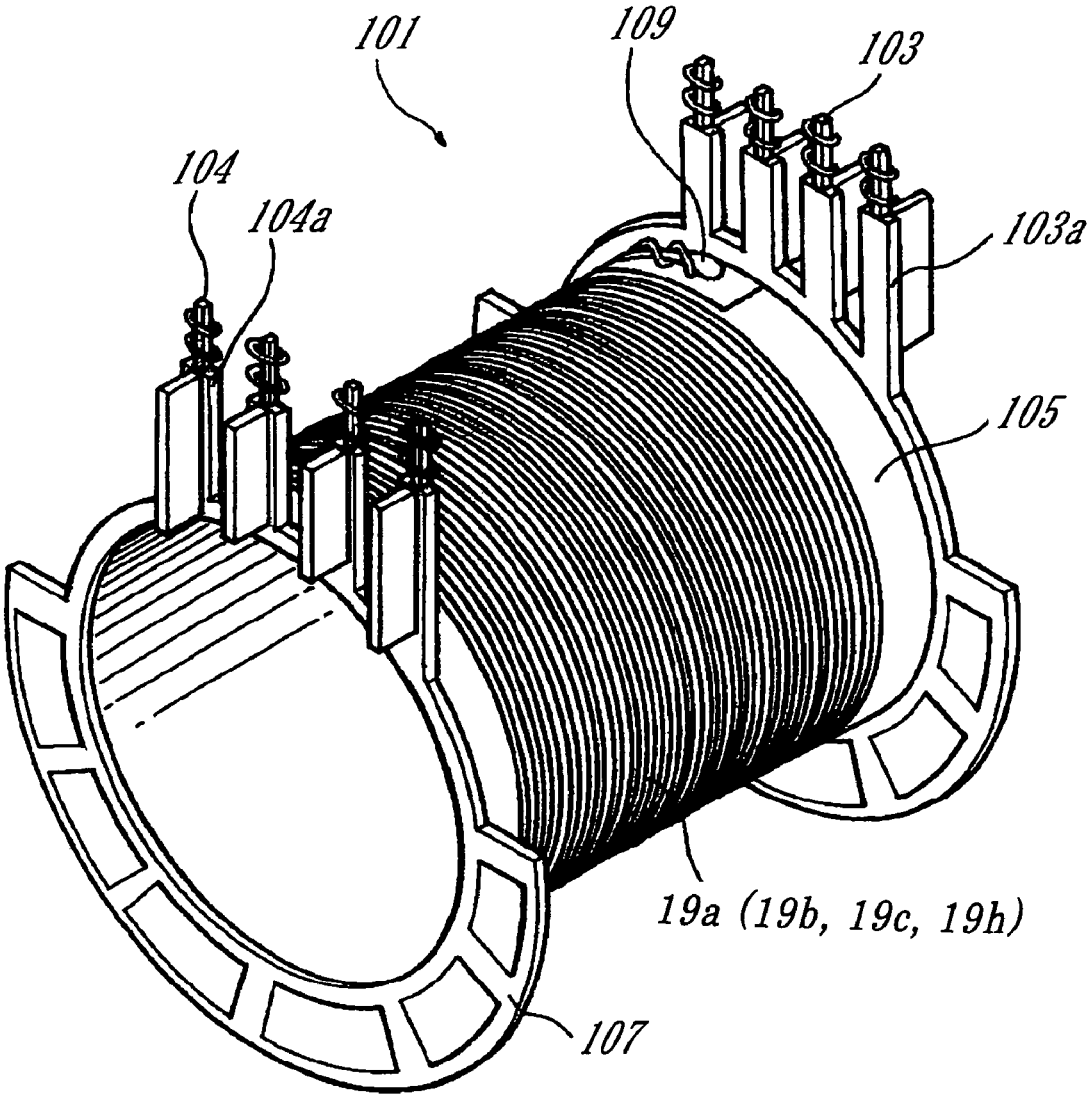
FIG. 1 is a perspective view of an example of a secondary winding system according to an embodiment of the step-up transformer of the present invention.

An embodiment of the step-up transformer according to the present invention will be described below, referring to the drawings.

Figure 9:
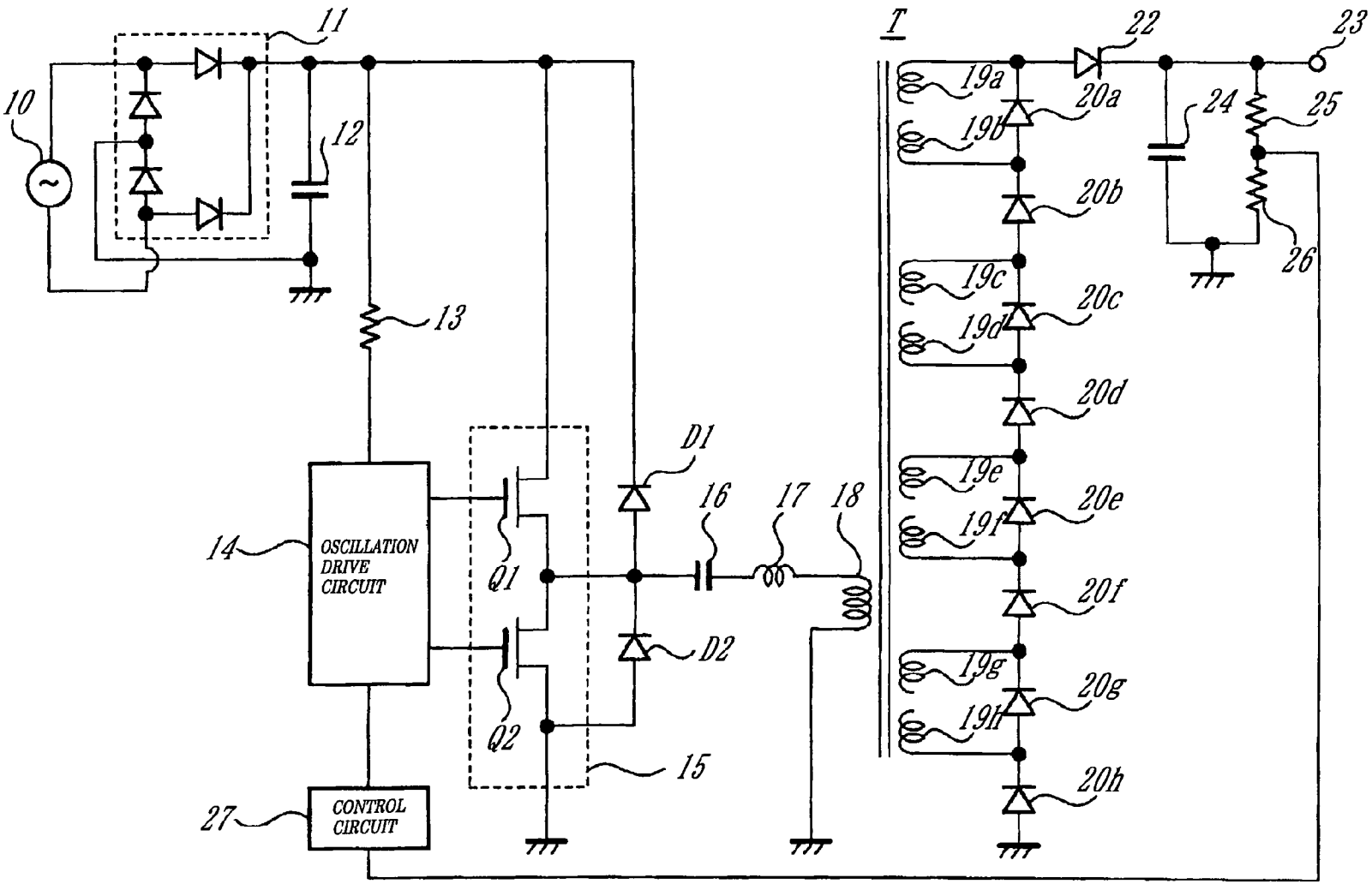
FIG. 9 is a circuit diagram showing an example of a step-up transformer.

The present embodiment will also be described referring to an example of application to a step-up transformer circuit as shown in FIG. 9.

Namely, in FIG. 9, symbol 10 denotes a commercial power source of, for example, 100 V and 50 Hz. One end and the other end of the commercial power source 10 are connected respectively to one input terminal and the other input terminal of a rectifying circuit 11 having a diode bridge configuration, a positive output terminal of the rectifying circuit 11 is earthed through a smoothing capacitor 12, and a negative output terminal of the rectifying circuit 11 is earthed.

The positive output terminal of the rectifying circuit 11 is connected to a power source terminal of an oscillation drive circuit 14 through a resistor 13, and the positive output terminal is earthed through a switching circuit 15 composed of a series circuit of switching devices Q1 and Q2, for example, field effect transistors (MOS-FETs). The switching circuit 15 is so driven that the switching devices Q1 and Q2 show alternate conduction at a predetermined frequency by the oscillation drive circuit 14.

Furthermore, the switching circuit 15 constitutes a half-bridge circuit, the positive output terminal of the rectifying circuit 11 is connected to the drain of the switching device Q1, and the source of the switching device Q2 is earthed. In addition, damper diodes D1 and D2 are connected in parallel to the switching devices Q1 and Q2, respectively.

A connection point between the source of the switching device Q1 and the drain of the switching device Q2 is earthed through a series circuit of a resonant capacitor 16, a coil 17, and a primary winding 18 of a step-up transformer T.

A primary winding 18 of the step-up transformer T is supplied with a current at a resonance frequency determined by the resonant capacitor 16, the coil 17, and the primary winding 18 of the series circuit.

Figure 12:
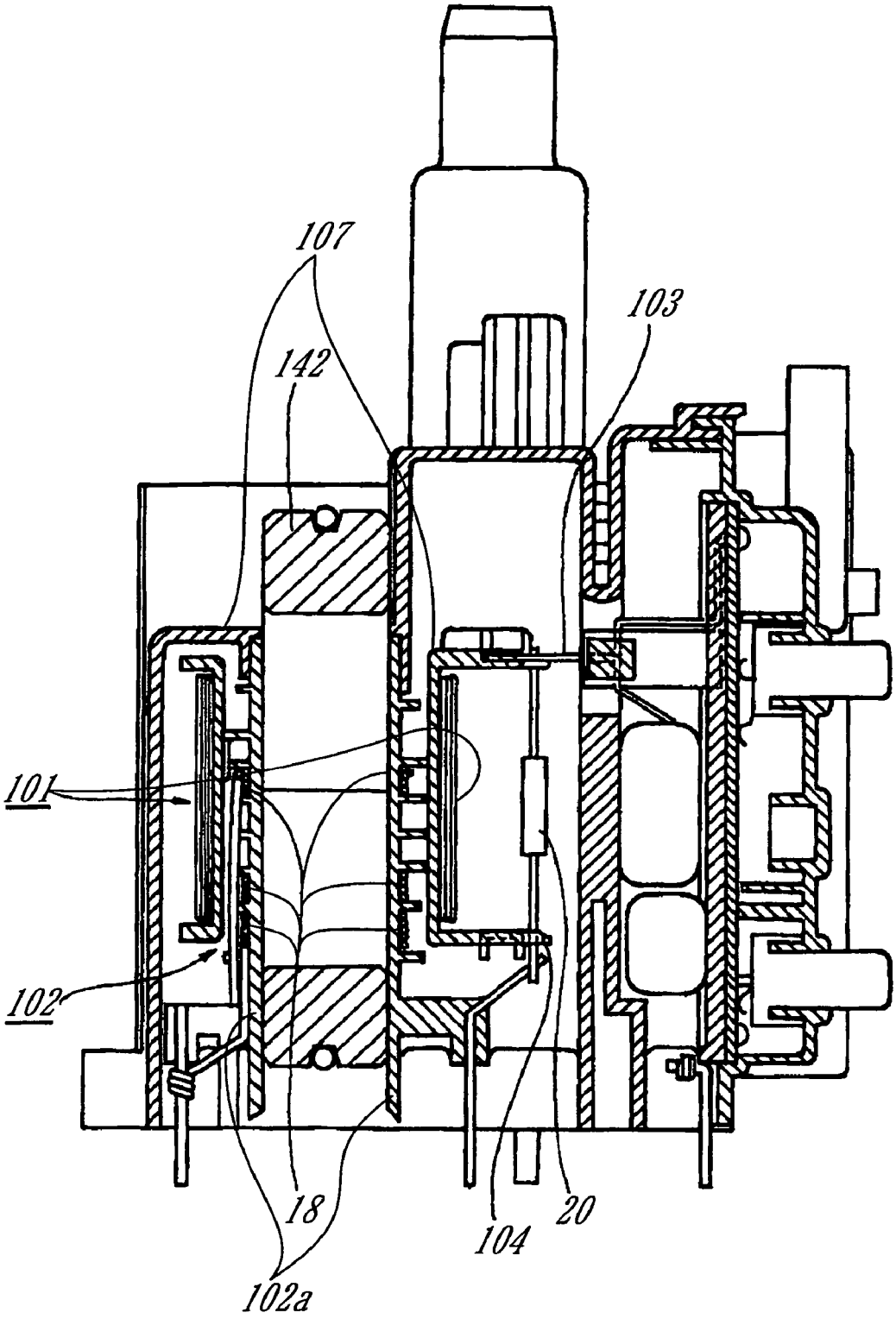
FIG. 12 is a sectional view showing the entire constitution of an example of a step-up transformer.
Figure 13:
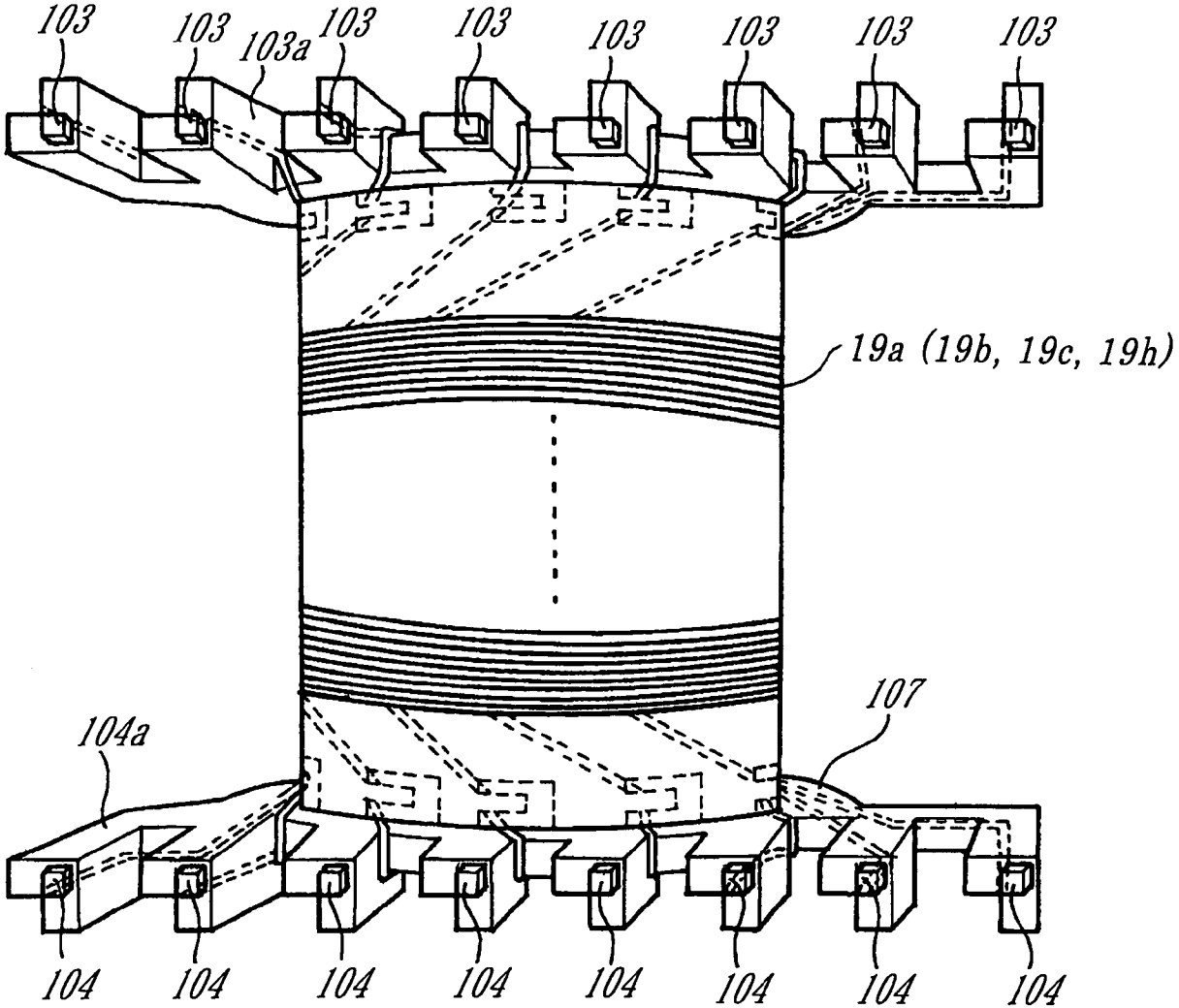
FIG. 13 is a plan view of an example of a conventional secondary winding system.

Incidentally, the primary winding 18 is wound around a bobbin 102*a*, as shown in FIG. 12.

Symbols 19*a*, 19*b* . . . 19*h* denote eight secondary windings which are laminated, with insulating films 105 therebetween, around a bobbin 107, are divided, for example, on the basis of the same number of turns, and are opened at one-side ends thereof. Rectifying diodes 20*a*, 20*b* . . . 20*h* are each connected, in a vertical row fashion, to a point between the other-side ends of each pair of the secondary windings, of the eight secondary windings 19*a*, 19*b* . . . 19*h*.

Specifically, the diode 20*a* is connected to a point between the other-side ends of the secondary windings 19*a* and 19*b*, the diode 20*b* is connected to a point between the other-side ends of the secondary windings 19*b* and 19*c*, the diode 20*c* is connected to a point between the other-side ends of the secondary windings 19*c* and 19*d*, the diode 20*d* is connected to a point between the other-side ends of the secondary windings 19*d* and 19*e*, the diode 20*e* is connected to a point between the other-side ends of the secondary windings 19*e* and 19*f*, the diode 20*f* is connected to a point between the other-side ends of the secondary windings 19*f* and 19*g*, the diode 20*g* is connected to a point between the other-side ends of the secondary windings 19*g* and 19*h*, and the diode 20*h* is connected to the other-side end of the secondary winding 19*h* and the earth.

Figure 10:
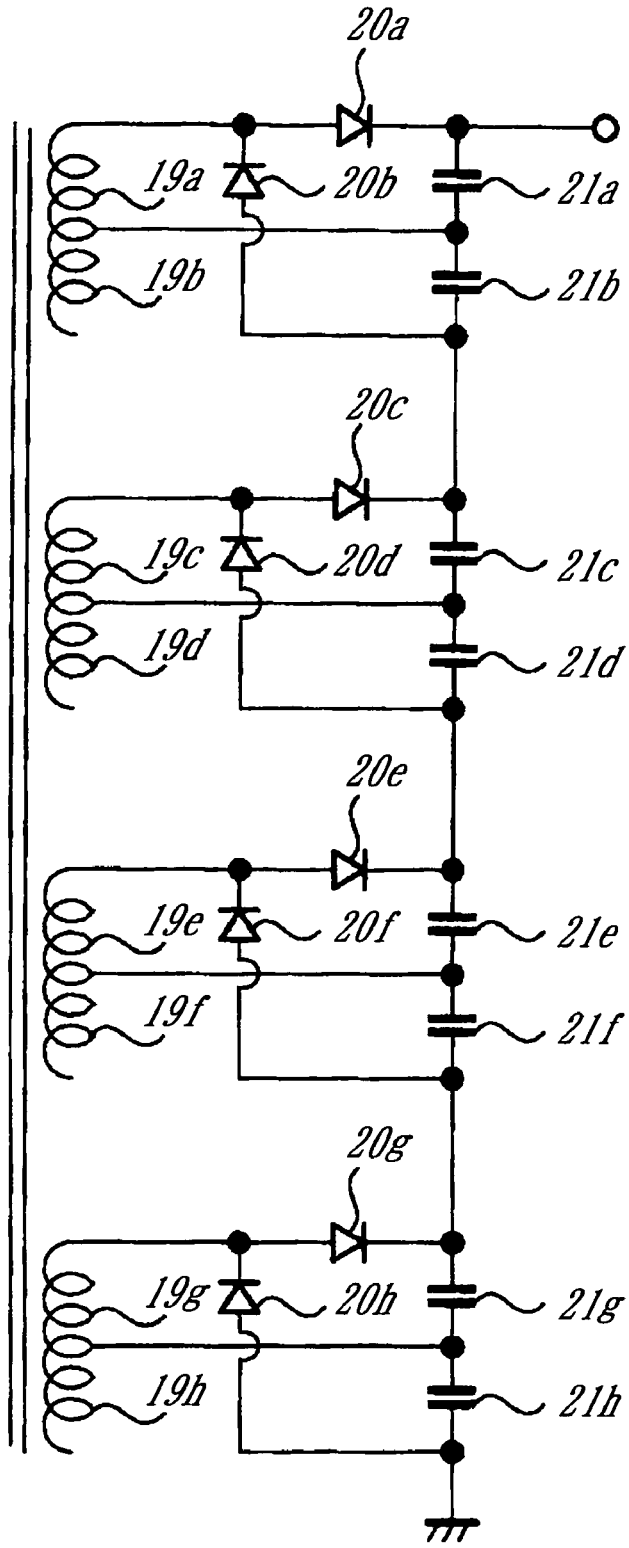
FIG. 10 is an equivalent circuit diagram of a secondary winding system of the step-up transformer shown in FIG. 9.

An equivalent circuit of the secondary winding system composed of the eight secondary windings 19*a*, 19*b* . . . 19*h* and the eight rectifying diodes 20*a*, 20*b* . . . 20*h* is as shown in FIG. 10. By subjecting voltages obtained at the secondary windings 19*a*, 19*b* . . . 19*h* to full-wave double-voltage rectification to produce DC voltages and laying up the DC voltages, it is possible to obtain a high DC voltage, for example, 32.4 kV. In FIG. 10, capacitors 21*a*, 21*b* . . . 21*h* are inter-layer capacitances of the secondary windings 19*a*, 19*b* . . . 19*h*.

In addition, the other-side end of the secondary winding 19*a* is connected to a high-voltage output terminal 23 through a diode 22, and a connection point between the diode 22 and the high-voltage output terminal 23 is earthed through a smoothing capacitor 24.

Besides, the high-voltage output terminal 23 is earthed through a series circuit of resistors 25 and 26, a detection voltage of a high voltage obtained at a connection point between the resistors 25 and 26 is supplied to a control circuit 27, and the oscillation frequency of the oscillation drive circuit 14 is controlled according to the DC voltage obtained at the high-voltage output terminal 23 by the control circuit 27 so that the high DC voltage obtained at the high-voltage output terminal 23 will be constant.

Figure 4:
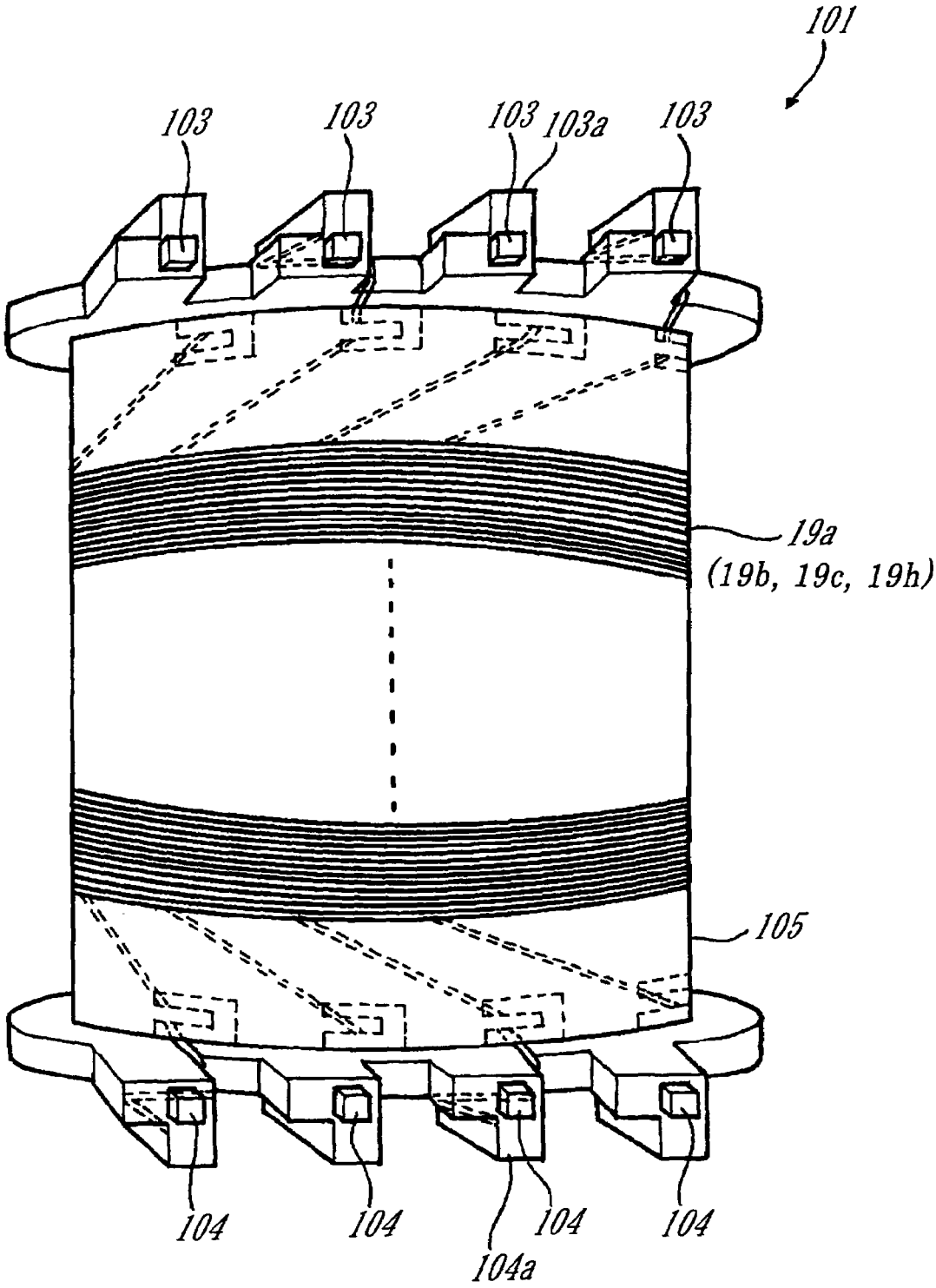
FIG. 4 is a plan view of an example of the secondary winding system shown in FIG. 1.
Figure 11:
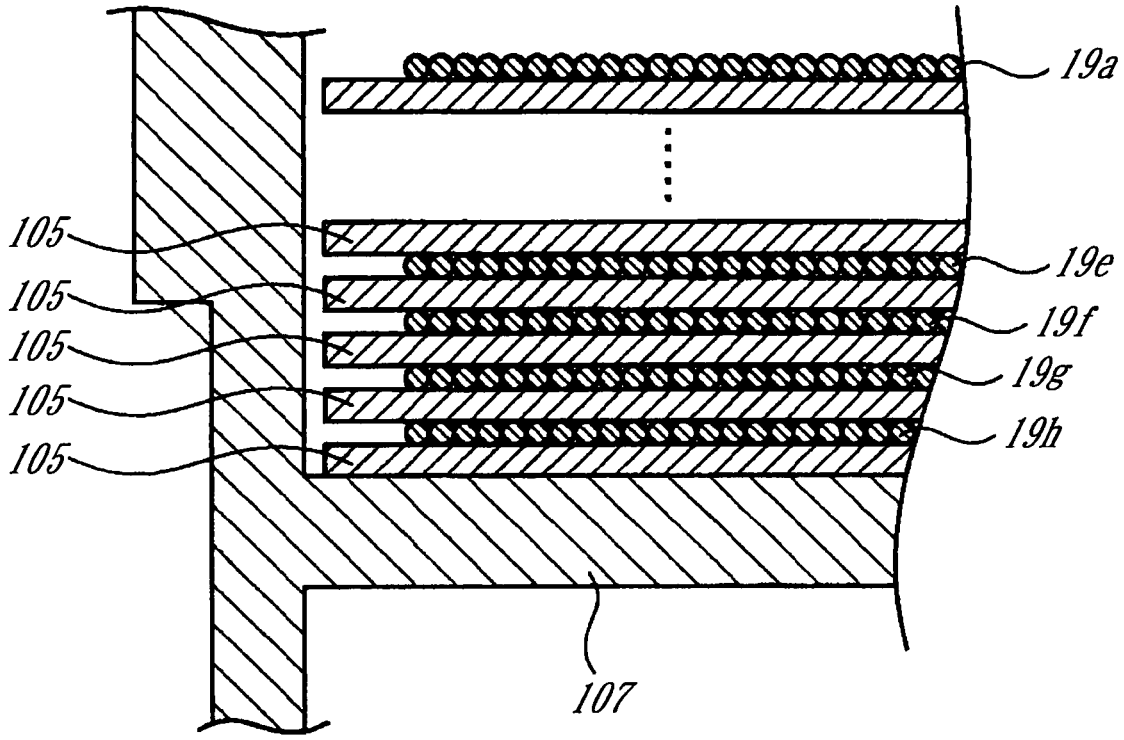
FIG. 11 is a partly enlarged sectional view of an example of the secondary winding system.

Meanwhile, a sectional view of an example of the entire constitution of the step-up transformer as shown in FIG. 9 is as shown in FIG. 12, in which symbol 101 denotes the secondary winding system. As shown in FIGS. 1, 4 and 11, the secondary winding system 101 has a structure in which the eight secondary windings 19*a*, 19*b* . . . 19*h* in the state of being laminated in eight layers with the insulating films 105 therebetween are wound around the outer circumferential surface of the roughly cylindrical bobbin 107 having walls along both side edges, the insulating films 105 are belt-like in shape, and the secondary windings 19*a*, 19*b* . . . 19*h* are so wound as to have a width slightly smaller than the width of the insulating films 105.

Incidentally, the bobbin 107 is formed by use of, for example, a PPE (polyphenylene ether) resin 1 mm thick, with an epoxy resin injected thereto, to insulate the primary winding 18 and the secondary windings 19*a*, 19*b* . . . 19*h* from each other.

Figure 2:
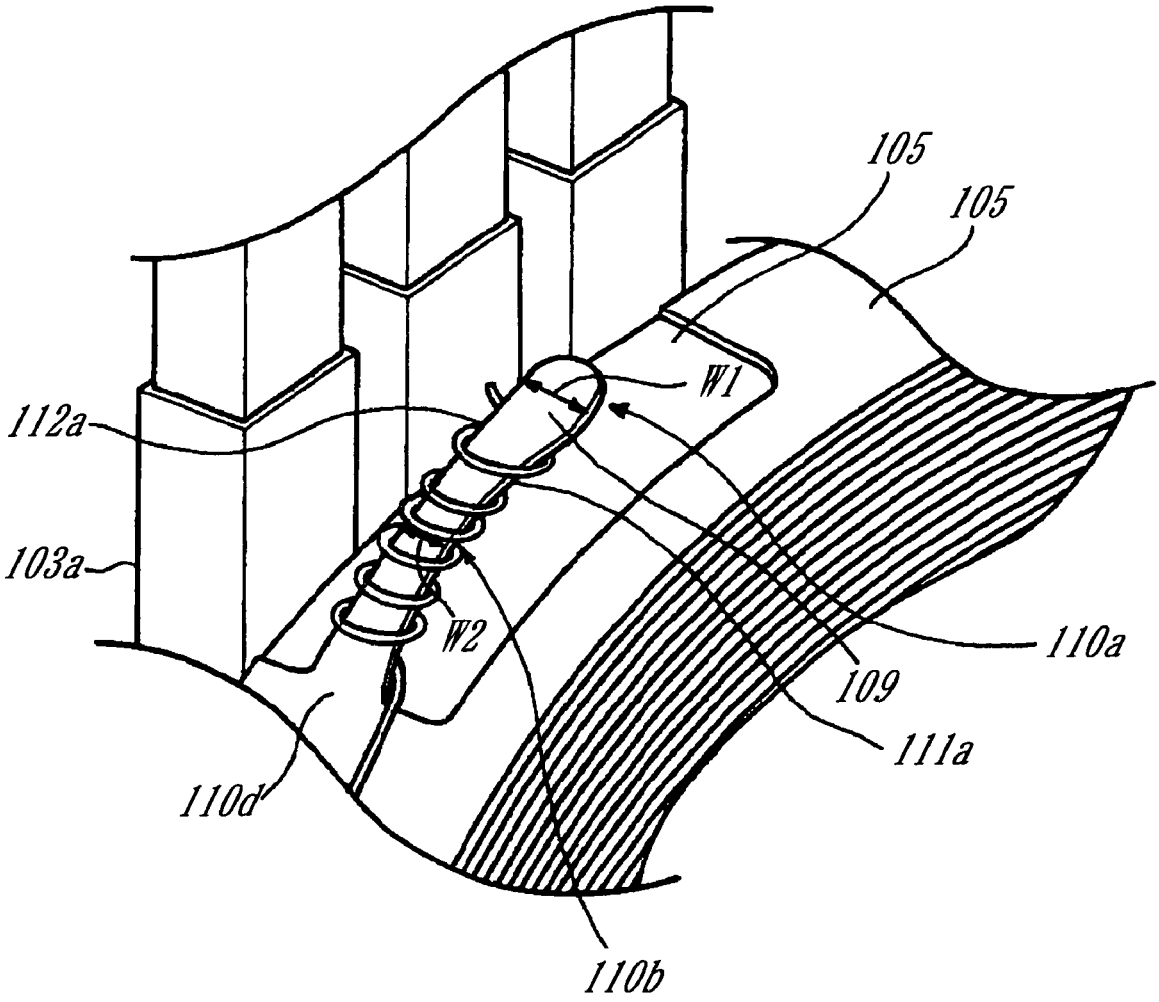
FIG. 2 is a partly enlarged perspective view of an example of an essential part of FIG. 1.
Figure 3:
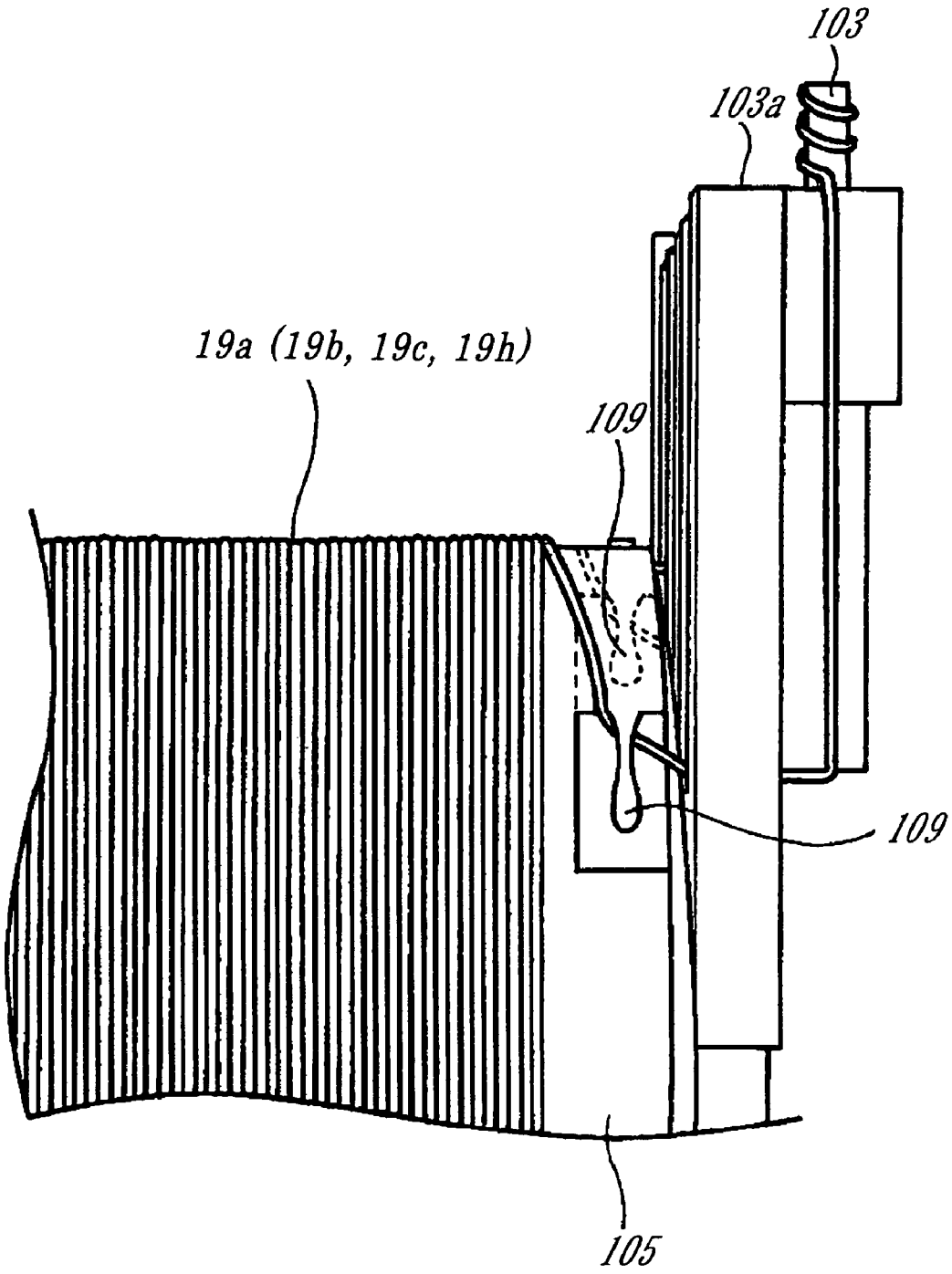
FIG. 3 is a partly enlarged perspective view for use in illustrating FIG. 1.

In this embodiment, a film projection portion 109 is formed by cutting and raising the insulating films 105 at each of both edges of the insulating films 105 where the windings constituting the secondary windings 19*a*, 19*b* . . . 19*h* of the secondary winding system 101 shown in FIGS. 1, 2, and 3 are not wound.

The film projection portion 109 is in the form of a strip of paper in the example shown in FIGS. 1 and 2, and has a right edge portion 111*a* and a left edge portion 112*a* as both sides along the longitudinal direction between a tip portion 110*a* and a base portion 110*d*.

The left edge portion 112*a* of the film projection portion 109 is rectilinear in shape, and the film projection portion 109 is in a recessed form (a recessed portion for retaining) at a central portion 110*b* of the right edge portion 111*a* (the side on one side) thereof.

In this embodiment, the open one-side ends of the eight secondary windings 19*a*, 19*b* . . . 19*h* are wound (bound) around the film projection portion 109.

The film projection portion 109 has a structure in which where the central portion 110*b* is in a recessed form as shown in FIGS. 1 and 2, the width W1 of the tip portion 110*a* is greater than the width W2 of the central portion 110*b*, so that when the one-side ends of the secondary windings 19*a*, 19*b* . . . 19*h* are wound around the central portion 110*b*, the one-side ends of the secondary windings 19*a*, 19*b* . . . 19*h* thus wound are less liable to be loosened and can be fixed securely.

In addition, in this embodiment, as shown in FIG. 3, the other-side ends of the secondary windings 19*a*, 19*b* . . . 19*h* are clamped by the film projection portion 109 on the opposite side of the film projection portion 109 around which the one-side ends are wound, then the other-side ends are fixed by winding them around the terminals 103 or 104 of the terminals 103 and 104 provided, through the terminal bases 103*a* and 104*a*, on one side and the other side of the bobbin 107, and the diodes 20*a*, 20*b* . . . 20*h* and the like are connected thereto, so as thereby to assemble the circuit as shown in FIG. 9.

Besides, as shown in FIG. 12, the secondary winding system 101 is disposed so as to penetrate through a core 142, which constitutes a closed magnetic circuit at the center thereof, together with the bobbin 102*a* and a primary winding system 102 constituted of the primary winding 18.

According to this embodiment as above, the open one-side ends of the eight secondary windings 19*a*, 19*b* . . . 19*h* are fixed by winding them around the film projection portion 109 formed by cutting and raising side portions of the insulating films 105. Therefore, where the number of the secondary windings 19*a*, 19*b* . . . 19*h* is eight, the number of the terminals 103 and 104 provided on the bobbin 107 can be four on each side, i.e., the number can be eight in total, as shown in FIGS. 1 and 4. Thus, the number of the terminals 103 and 104 to be provided on the bobbin 107 can be reduced to ½ times the ordinary number in the conventional design, and the bobbin 107 can be made smaller in size accordingly.

In addition, FIGS. 5 to 8 show other examples of the film projection portion 109 of the insulating film 105 around which to wind the one-side ends of the secondary windings 19*a*, 19*b* . . . 19*h*. In the following description of FIGS. 5 to 8, the portions corresponding to those in FIG. 2 are denoted by the same symbols as used above, and description of the portions will be omitted.

Figure 5:
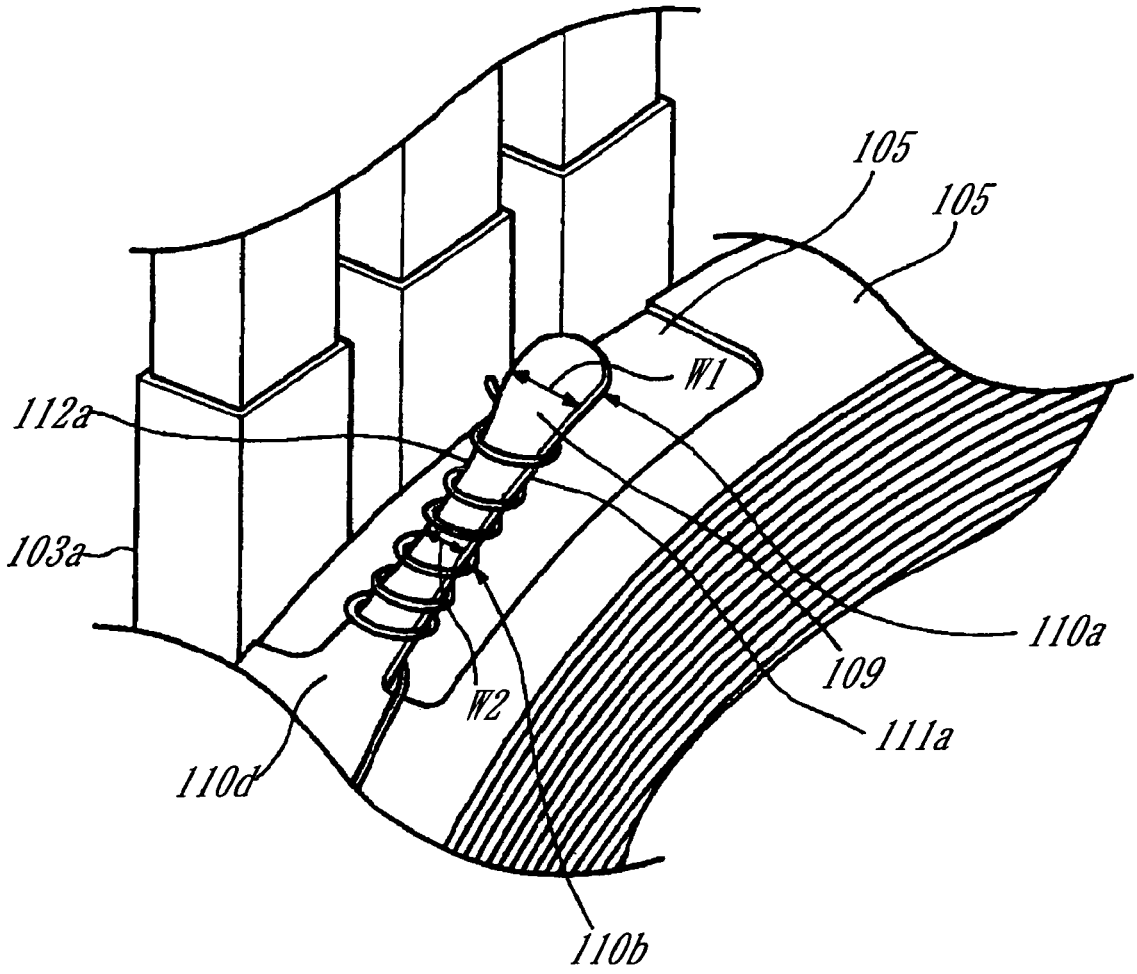
FIG. 5 is a partly enlarged perspective view of another example of the essential part of FIG. 1.

A film projection portion 109 in the example shown in FIG. 5 is in the form of a strip of paper, and has a right edge portion 111*a* and a left edge portion 112*a* as both sides along the longitudinal direction between a tip portion 110*a* and a base portion 110*d* thereof. The right edge portion 111*a* is rectilinear in shape, while the left edge portion 112*a* is in the form of being recessed at a central portion 110*b*.

It will be easily understood that in the example shown in FIG. 5, also, the same function or effect as that in the example shown in FIG. 2 can be obtained.

Figure 6:
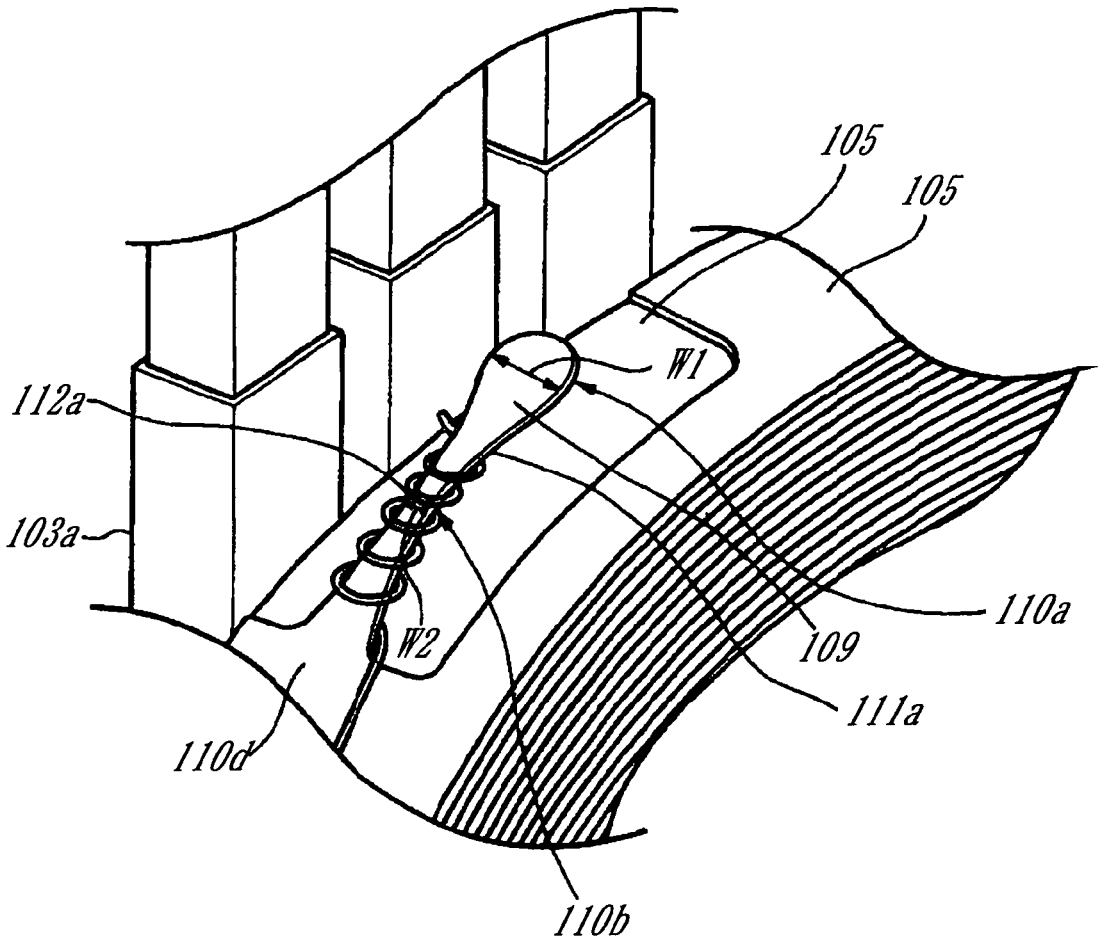
FIG. 6 is a partly enlarged perspective view of a further example of the essential part of FIG. 1.

A film projection portion 109 in an example shown in FIG. 6 is in the form of a strip of paper, in which a right edge portion 111*a* and a left edge portion 112*a* as both sides along the longitudinal direction between a tip portion 110*a* and a base portion 110*d* are in the form of being recessed at a central portion 110*b*.

It will be easily understood that in the example shown in FIG. 6, also, the same function or effect as that in the example shown in FIG. 2 can be obtained.

Figure 7:
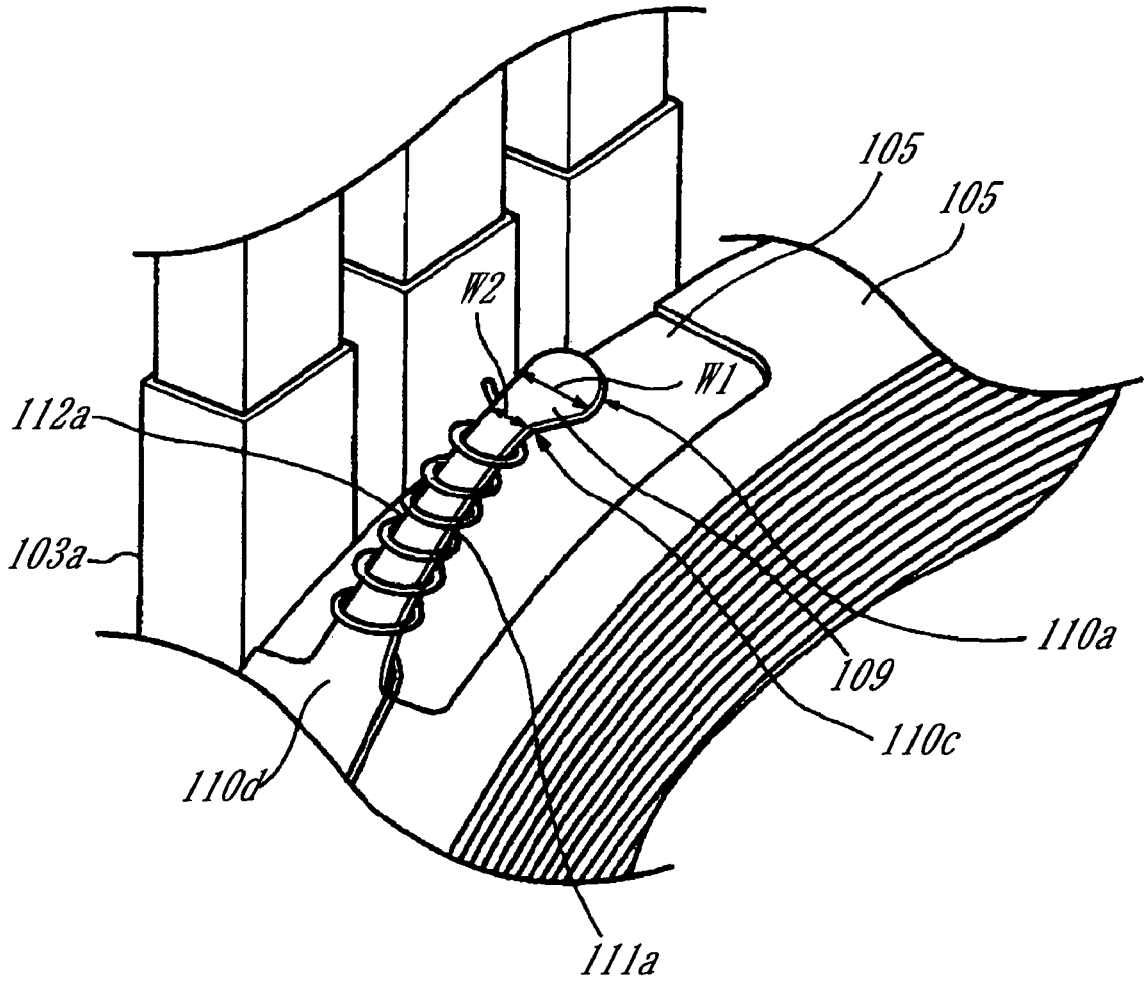
FIG. 7 is a partly enlarged perspective view of yet another example of the essential part of FIG. 1.

A film projection portion 109 in an example shown in FIG. 7 is in the form of a strip of paper, and has a right edge portion 111*a* and a left edge portion 112*a* as both sides along the longitudinal direction between a tip portion 110*a* and a base portion 110*d* thereof. The width of the film projection portion 109 gradually decreases as one goes from the base portion 110*d* toward the tip portion 110*a*, and the right and left edges are most recessed at a portion immediately before the tip portion 110*a;* thus, the film projection portion 109 as a whole is in the form of being recessed at a narrow portion 110*c*.

In the example shown in FIG. 7, where one-side ends of secondary windings 19*a*, 19*b* . . . 19*h* are wound around the film projection portion 109, the one-side ends of the secondary windings 19*a*, 19*b* . . . 19*h* thus wound are less liable to be loosened and can be fixed securely, since the width W1 of the tip portion 110*a* is greater than the width W2 of the narrow portion 110*c*.

Figure 8:
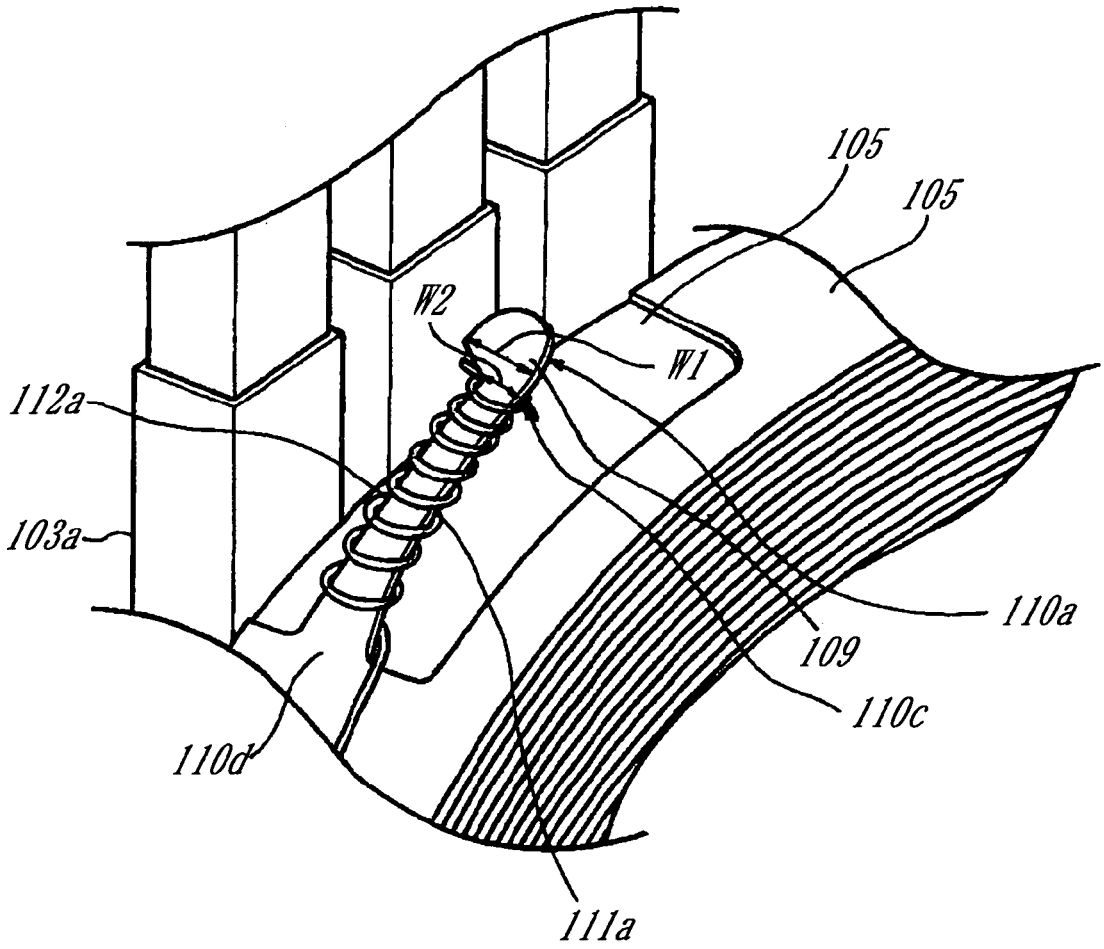
FIG. 8 is a partly enlarged perspective view of a still further example of the essential part of FIG. 1.

A film projection portion 109 in an example shown in FIG. 8 is in the form of a strip of paper, and has a right edge portion 111*a* and a left edge portion 112*a* as both sides along the longitudinal direction between a tip portion 110*a* and a base portion 110*d* thereof. The right edge portion 111*a* and the left edge portion 112*a* have shapes reverse to those in the example shown in FIG. 7. Therefore, the width of the film projection portion 109 decreases as one goes from the base portion 110*d* toward the tip portion 110*a*, and the right and left edges are recessed most deeply at a portion immediately before the tip portion 110*a;* thus, the film projection portion 109 as a whole is in the form of being recessed at a narrow portion 110*c*.

It will be easily understood that in the example shown in FIG. 8, also, the same function or effect as that in the example shown in FIG. 7 can be obtained.

While the number of the secondary windings has been eight in the above examples, the number is determined as required according to the high voltage needed, so that the number naturally may not necessarily be eight.

In addition, the present invention is not limited to the above embodiment or examples, and various modifications can naturally be adopted without departure from the gist of the invention.

INDUSTRIAL APPLICABILITY

According to the present invention, open one-side ends of a plurality of secondary windings are fixed by winding them around a film projection portion formed by cutting and raising insulating films provided between the layers of the windings. This ensures that the number of terminals provided on a bobbin can be cut down by a number corresponding to the number of the windings fixed by winding around the film projection portion, and the bobbin can be made smaller in size accordingly.

The invention claimed is:

1. A step-up transformer comprising:

a primary winding supplied with a switching voltage that switches at a predetermined frequency;

a plurality of secondary windings for stepping up said switching voltage supplied to said primary winding, wherein said secondary windings are laminated in a plurality of layers, are divided based on a predetermined number of turns, and respectively are opened at first ends thereof;

a bobbin for providing a predetermined spacing between said plurality of secondary windings and said primary winding and including a plurality of terminals for respectively winding second ends of said plurality of secondary windings therearound;

a core inserted in said bobbin, excited by said switching voltage supplied to said primary winding, and forming a closed magnetic circuit;

a plurality of insulating films wound around said bobbin so as to space said plurality of secondary windings from each other by respective predetermined thicknesses;

rectifying portions provided at the second ends of said plurality of secondary windings for rectifying stepped-up voltages obtained at the second ends of said secondary windings; and a cut out film projection portion formed on each of said plurality of insulating films wherein said portion includes a substantially rectilinear shape around which the first ends of said secondary windings are wound.

2. The step-up transformer as set forth in claim 1, wherein said film projection portion comprises a retaining recessed portion for fixing the first ends of said secondary windings by having the first ends wound therearound.

3. The step-up transformer as set forth in claim 1, wherein said film projection portion has a shape in which at least one side along a longitudinal direction between a tip portion and a base portion thereof is recessed.

4. The step-up transformer as set forth in claim 1, wherein said film projection portion has a shape in which a width thereof decreases going from said base portion toward said tip portion thereof, and the width thereof is smallest at a portion immediately before said tip portion thereof.

5. The step-up transformer as set forth in claim 1, further comprising a resonant capacitor and an inductor connected to said primary winding, whereby said switching voltage supplied to said primary winding has a resonant waveform.

6. The step-up transformer as set forth in claim 1, wherein said rectifying portions comprise diodes each connected, in a vertical row fashion, to a point between the second ends of each adjacent pair of secondary windings of the plurality of secondary windings, voltages obtained at said secondary windings are subjected to full-wave double-voltage rectification to produce DC voltages, and said DC voltages are summed to obtain a high voltage.

7. The step-up transformer as set forth in claim 6, further comprising:

switching devices for producing said switching voltages; a drive circuit for driving said switching devices; and a control circuit for controlling a frequency of said drive circuit based on said high voltage.

* * * * *